US006985790B2

(12) United States Patent
Begemann et al.

(10) Patent No.: US 6,985,790 B2
(45) Date of Patent: Jan. 10, 2006

(54) METHOD FOR MANUFACTURING AND CONVERTING OF PAPER

(75) Inventors: Ulrich Begemann, Heidenheim (DE); Alfred Schauz, Nattheim (DE)

(73) Assignee: Voith Paper Patent GmbH, Heidenheim (DE)

( * ) Notice: Subject to any disclaimer, the term of this patent is extended or adjusted under 35 U.S.C. 154(b) by 819 days.

(21) Appl. No.: 09/799,134

(22) Filed: Mar. 5, 2001

(65) Prior Publication Data

US 2001/0020523 A1 Sep. 13, 2001

(30) Foreign Application Priority Data

Mar. 7, 2000 (DE) ..... 100 11 067

(51) Int. Cl.
*G06F 7/66* (2006.01)

(52) U.S. Cl. ..... 700/127; 162/263

(58) Field of Classification Search ..... 700/127–129; 162/198, 263, DIG. 10, DIG. 12
See application file for complete search history.

(56) References Cited

U.S. PATENT DOCUMENTS

| | | | | |
|---|---|---|---|---|
| 5,771,174 A * | 6/1998 | Spinner et al. | ..... | 700/129 |
| 5,781,440 A * | 7/1998 | Adamy | ..... | 700/122 |
| 6,086,237 A * | 7/2000 | Gorinevsky et al. | ..... | 700/127 |
| 6,094,604 A * | 7/2000 | Bucher et al. | ..... | 700/129 |
| 6,099,178 A * | 8/2000 | Spurr et al. | ..... | 400/207 |
| 6,126,785 A * | 10/2000 | Hu et al. | ..... | 162/198 |
| 6,168,687 B1 * | 1/2001 | Hu et al. | ..... | 162/198 |
| 6,200,422 B1 * | 3/2001 | Shakespeare et al. | ..... | 162/198 |
| 6,217,940 B1 * | 4/2001 | Kuni | ..... | 427/356 |
| 6,392,681 B1 * | 5/2002 | Wood et al. | ..... | 347/218 |

FOREIGN PATENT DOCUMENTS

| | | |
|---|---|---|
| DE | 89 10 551 | 9/1989 |
| DE | 196 32 988 | 1/1998 |
| DE | 199 18 399 A1 | 11/1999 |
| EP | 0 826 821 A2 | 8/1997 |
| EP | 0 891 863 | 1/1999 |
| WO | WO 97 18 349 A1 | 5/1997 |

OTHER PUBLICATIONS

Schwarz, Moritz: Vernetzt—In: dw8, Nov. 1999, p. 40, 41.
Fuchs, Boris: Analysis of Weaknesses in News print in Rotary Machines. In: Der Polygraph, Jul. 11, 1997, S.79-83.
Sandig, Dr. Martin: Handbuch der Papier- und Pappenfabrikation. Verlagsabteilung TextW, Niederwalluf, Bd. 11, 2.Aufl., ISBN 3500 16 000X, S.1459,1460.
Gottsching, Lothar: Papier Lexikon, Deutscher Betriebswirte Verlag GmbH, Gernsbach 1999, ISBN 3-88640-080-8, S.128, 129.

* cited by examiner

*Primary Examiner*—Albert W. Paladini
*Assistant Examiner*—Zoila Cabrera
(74) *Attorney, Agent, or Firm*—Taylor & Aust, P.C.

(57) ABSTRACT

In a method for the production and converting of paper, paper-specific information determined during paper production is transmitted to and considered during the respective converting process to thereby optimize at least one converting process.

29 Claims, 3 Drawing Sheets

METHOD FOR MANUFACTURING AND CONVERTING OF PAPER

BACKGROUND OF THE INVENTION

1. Field of the Invention

The invention relates to a method for manufacturing and converting of paper.

2. Description of the Related Art

During the paper manufacturing process a multitude of characteristics, mostly mechanical or technological paper characteristics which are important for one or more subsequent converting processes are determined. These change during production to a greater or lesser extent, even within a specific type of paper, and across the web width. A particular converting process may, for example, be a printing process, a formatting process, specifically a cutting process, etc.

Web shrinkage for example, is dependent not only on the specific cross width position, but also on the fiber characteristics and the tensions in the paper machine.

The aforementioned position related information regarding web characteristics are not available to the printer. As far as shrinkage is concerned, the printer is possibly familiar with the shrinkage across the entire width of an entire roll.

One of the most pressing problems in news print are the varying width expansion characteristics in the paper during printing, specifically during color printing. The reason for this is the effect of moisture on the paper during printing. During a multi-color printing process the web runs through several printing stations within a short time period. Hitherto the art work had to be adjusted to the expansion characteristics of the paper, resulting in corresponding time and raw material losses at the printers.

Individual paper rolls display individually different moisture related expansion characteristics. Paper, manufactured at the edge of the paper machine, displays a greater moisture expansion, as well as related greater tolerance values.

During the production process through to completion, the paper shrinks in varying degrees, in transverse direction to the web direction.

Two possible cross directional shrinkage curves are illustrated in FIGS. 1*a* and 1*b*. In each of the illustrations, the operator side shrinkage is depicted on the left, and the drive side shrinkage in the paper machine is depicted on the right.

The shrinkage is generally uniformly constant in the center, while the paper tends to increasingly shrink toward both edges. While the shrinkage depicted in FIG. 1*a* is constant in the center, this constancy is not achieved in certain instances (see FIG. 1*b*). A different shrinkage behavior may also occur due to various raw material combinations and production processes. As may also be seen in FIGS. 1*a* and 1*b*, the curve profile may differ greatly in the edge areas, whereby it is always non-linear in this area. Attempts are made through constructive measures to expand the center area as much as possible.

The paper produced in the paper machine is subsequently wound on so-called reel spools. The resulting fully wound rolls normally have a width of 2 m to more than 10 m and a diameter of almost 4 m, and possibly more.

Initial converting of these fully wound rolls takes place at the paper manufacturer. The preference is to convert paper for news print into smaller rolls on roll slitters. Common widths are 0.3 m to 1.4 m, sometimes even 2.8 m and diameters from 0.9 m to 1.5 m, whereby the tendency here too is for larger dimensions. Paper intended for cardboard packaging is usually cut into individual sheets on sheet cutters.

For ease of presentation we refer in the following text primarily to roll paper. However, the same conditions also apply to sheet paper.

During the printing process the paper expands transversely to the direction of travel. This expansion, or fan out, is in direct relationship to the shrinkage described above.

Paper, that shrank uniformly across its entire width during production, expands (fans out) again uniformly during printing. In partially multicolored printed paper, this fan out may be compensated for by offsetting the printing plates in the subsequent print stations by some 1/10 mm toward the web edge. Also, targeted expansion of the printing plates, for example in full-area color printing, is possible.

Paper that did not shrink uniformly during production becomes problematic with increasing roll widths. Therefore, non-uniform shrinking during paper production results in non-constant expansion or fan out during printing. Registration problems may only be compensated partially through the aforementioned measures. Fan out during printing may measure from several tenths of a millimeter to 3 mm or more, depending on the type of paper and the specific location on the roll. With increasing width of rolls that do not have constant transverse shrinkage, it becomes increasingly more difficult, particularly with full-area color print, to achieve the desired quality print result. In order to achieve the optimum print results the printing plates should for example be expanded at the edge of the roll by 3 mm, whereby the expansion should reduce to 0.3 mm toward the roll center, in order to remain at a constant 0.3 mm for the remaining roll half. A further problem exists in that an uneven web tension may occur in the printing machine when converting such rolls. To begin with, this is to be attributed to the non-linear longitudinal expansion behavior which, in turn, is dependent on the respective transverse shrinkage during production. This uneven web tension increases the risk of web breaks on one side and may lead to registration problems on the other side of the roll and, in extreme cases, may lead to wrinkle formation.

In a method for influencing the fan out in wet-offset rotary printing—known from German patent document no. DE 199 18 399 A1—a width or cross directional fan out of the paper web is determined by measuring one run of a paper web between a pull roll of a pre-tensioning device located prior to several printing cylinders, and an outfeed pull roll following the printing cylinders. The determined width of cross directional fan out is utilized for the drive control of at least one of the pull rolls, in order to achieve a constant width, or transverse fan out of the paper web. In this instance, the values utilized for the control are measured in the printing press area.

SUMMARY OF THE INVENTION

The present invention provides an improved method of manufacturing and converting paper in which the aforementioned disadvantages have been eliminated.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1A:
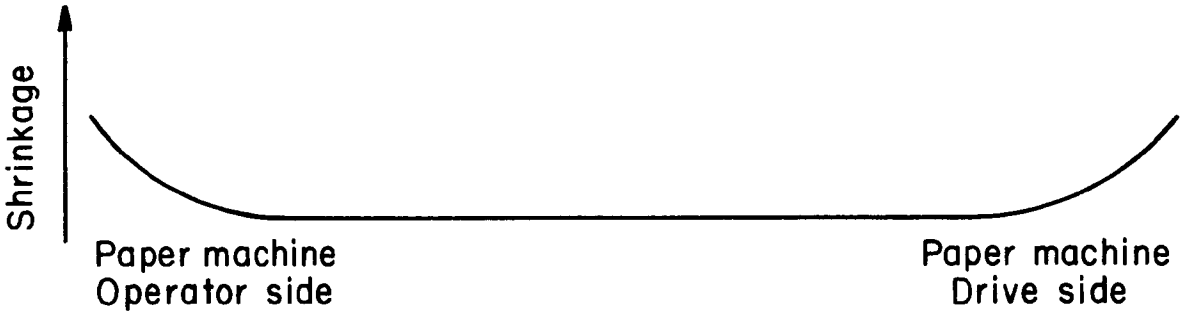
FIG. 1*a* is a plot of the cross directional shrinkage behavior during production of a paper web.
Figure 1B:
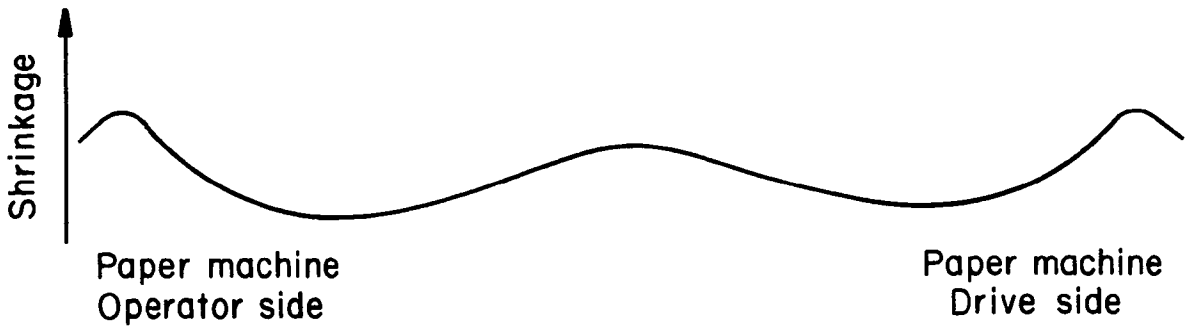
FIG. 1*b* is another plot of the cross directional shrinkage behavior during production of a paper web.

In accordance with the current invention for the purpose of optimization of a converting process, information that was determined during paper production regarding a particular paper is transmitted to and considered in the respective converting process.

A particular converting process may for example, be a printing process, a formatting process, specifically a cutting process, etc. It is also fundamentally possible to consider such information gained during the paper production in several converting processes.

Information regarding a specific paper as determined during production and transmitted to and considered during the converting process can include mechanical and/or technological characteristics. Specifically, these may be characteristics such as tensile strength, fan out behavior, gloss, smoothness, density, fiber orientation, basis weight, moisture, roughness and/or other characteristics of that kind.

In certain instances it may also be advantageous if paper specific information discovered during paper production and transmitted to and considered during the respective converting process would include information regarding the paper components or paper composition. The relevant information may for example refer to filler type, filler volume, fiber type, fiber volume, chemical additives, etc.

In another useful form of the method according to the invention, paper specific information discovered during paper production and transmitted to and considered during the respective converting process would include information regarding at least one characteristic and/or composition longitudinal profile. For example "linear footage" related information may be transmitted and considered.

In certain instances it may also be advantageous if at least one characteristic and/or combination cross profile is transmitted to and considered during the respective converting process.

In another advantageous form of the method according to the current invention, paper specific information discovered during paper production and transmitted to and considered during the respective converting process would include information regarding at least one longitudinal profile and at least one cross directional profile of data affecting the paper web. In this context, specifically the transmission of a relevant information screen or information net would be possible.

Information determined during paper production can be allocated to each roll via a data medium following a roll slitting process. Specifically, the roll slitting process may occur in the paper factory.

In one embodiment of the method in accordance with the invention in which the converting process is a printing process, the shrinkage of a particular paper that occurred during the manufacturing process is considered accordingly during printing, in order to optimize the printing process.

During subsequent printing, paper and location-specific characteristics are available which may accordingly be used for remote control of the printing machine. Based on the location-specific information, a constant optimum registration setting may, for example, be possible.

In the method according to the invention, it can also be taken into account that the determining parameter for the moisture based expansion during printing is the cross directional shrinkage of a paper web occurring during paper production.

Based on this cross directional shrinkage occurring individually during paper production, the roll-specific expansion of a paper roll during printing is predictable.

Such a prediction can be based, for example, on otherwise constant edge characteristics such as:

- the raw material composition of the paper
- the basis weight
- the extent of re-moistening during printing
- the web tensions during printing
- the longitudinal shrinkage during paper production, whereby longitudinal and cross directional shrinkage are not independent from each other
- the web tensions during winding on the paper machine and the roll slitter and/or
- the web tension in the paper machine.

The standard model for the prediction of the fan out may be expanded as desired, taking into account such edge characteristic parameters.

Just how many parameters are considered depends on the intended purpose. In the area of newsprint, accuracies of some 1/100 mm are sufficient. When printing folding box carton, distinctly higher accuracies are necessary.

During printing, the fan out as well as web tension differentials across the roll can be compensated for by suitable measures on the basis of the shrink characteristics of the paper.

The cross directional shrinkage which occurs during manufacture of a paper web is well known. Therefore, the cross directional shrinkage curve is calculated on all paper machines equipped with a Voith Sulzer ModuleJet® headbox and software package Profilmatic M®.

In doing so, individual values from across the web (for example, at distances of approximately 65 mm) are available for the cross directional web shrinkage. The appropriate values are continuously updated and recorded by the Voith Sulzer ModuleJet®.

Paper factories establish a data record for every produced roll whereby usually consecutive numbering, that is, the so-called "roll number", serves as a control key. These data records normally include the web width and the overall roll length, the basis weight, the paper type and several longitudinal and cross directional profile values. These data records serve as a basis for further converting and also as investigational material in the event of customer complaints.

For example, the relevant specific characteristics could be allocated individually to each produced "square meter".

In accordance with the invention, the existing data structure could then specifically be updated with the individual shrinkage values. This could, for example, be accomplished by recording cross directional shrinkage values at (cross directional) distances of 10 cm after every kilometer of paper length. Depending upon requirements, other distances are also possible. If converting requirements of the paper are established (i.e., the required width of a paper roll), then the average value of the relevant shrinkage values in longitudinal and cross direction, as well as the individual cross directional shrinkage curve can be determined.

This will permit the printer to determine for a particular paper type which fan out corresponds with the shrinkage value of a paper roll having constant shrinkage. The printer is then in a position to use this thereby determined factor between shrinkage value and fan out for every additional roll of that particular paper type, thus compensating for fan out in advance.

For simplification, the shrinkage curve may, for example, be approximated by a straight line or a segment of a circle and be described by a deflection value and an edge offset value.

If a printer is to print a paper roll having irregular shrinkage, then the printer has parameters available with the help of which he can make targeted corrections.

With newspapers that are not fully color printed, the roll side having the lower shrinkage values may be chosen for the color segment. On papers whose entire area is printed, the expansion of the art work from its rectangular basic shape to a trapezoid shape could be compensated for with the help of the aforementioned straight line for the description of the shrinkage curve, in order to improve the print result accordingly. The straight line is defined, for example, by the two shrinkage values present at the roll edge. Based on the now known correlation between the shrinkage value and the fan out, it enables the printer to adapt the printing plate accordingly.

In order to compensate for uneven cross directional web tensions, one embodiment includes installing a so-called spreader roll. The paper can wrap around the roll in an obtuse angle. If the curve of the spreader roll points into the direction of the peak of this obtuse angle, then the web tension in the center of the paper web is increased to a maximum, while reducing it toward the paper web edges. If the curve points in the direction of a leg of the obtuse angle, or is accomplished through appropriate pivoting of the spreader roll so that the paper only touches the roll, then the web tension distribution remains largely unchanged. By pivoting of the curve between these two positions, any intermediate values of this web tension influence may also be determined.

Another embodiment removes uneven paper fan out through targeted moistening. With the assistance of one of the hitherto known methods for metered application onto the paper web (as utilized on coaters) targeted moisture is applied onto the paper in the printing press, so that, for example, paper areas having lower shrinkage values are moistened more heavily than paper areas having higher shrinkage values, resulting in a more uniform expansion of the paper.

The relevant shrinkage rating can be noted on the roll label during packaging of the paper at the paper factory. Even the paper web can be marked with the relevant data during the production process at the paper mill. In the simplest case scenario, information is printed in the edge area in the visible wave range by a high speed printer and is then scanned at the latest during printing. Other identification methods which produce information in the non-visible area, and which therefore also do not have a negative influence on the printing quality, are also possible. This information can be applied not only in the edge area of the web, but also on the edge of a roll.

Concerning the location for information application onto the paper, this can be done at several locations simultaneously in the paper machine. But it is, for example, also possible to apply this information at the time of cross or longitudinal cutting of the web, i.e., at the edge of the sheets or the rolls. All process steps occurring during paper production that are relevant to the printing process can be combined with each other so that the relevant information, together with the location information, is transmitted to the recording device at the cutting device. The advantage of such an arrangement is that the printing process can be optimized and that a simple and clear allocation exists between the respectively described characteristics and the location, despite a large volume of data.

Instead of documenting the position-related information on the paper web, this can also be provided to the printer in the form of a separate data storage medium, i.e., a CD-ROM, or via a data network. In this instance, a clear allocation of the data record to the specific paper roll, or pallet must be ensured. The particular advantage of such a system, in addition to optimization of the printing process, is that the data is provided prior to the web or sheet entering the printing press.

Since there are now more possibilities available to the printing operation for compensation of certain negative paper characteristics, edge papers can specifically be used which hitherto were categorized as inferior compared to papers from the center area.

For example, the following shrinkage control is possible: in many instances the required finished roll width or sheet width is a factor already known during the master spool production. The paper shrinkage can be adjusted and/or controlled so that the paper shrinkage of the left end roll—when viewed in direction of paper travel—decreases linearly toward the paper machine center, remains constant on the neighboring rolls, and lastly, viewed in the direction of paper travel, again increases linearly on the right end roll. In order to control shrinkage, air may be introduced to the felt underside. This creates a type of air cushion between the felt and the paper in whose area the paper shrinks linearly. Depending on the influence over the moisture profile, the air may be introduced directly or by blowing onto a drying cylinder. The flow through the drying cylinder can be adjusted through air pressure. Ideally, such an air cushion should be formed in the area of the edge roll width, with the exception of the outermost web edge.

Local paper web shrinkage information can be determined, for example, by evaluating identifications which were applied prior to the shrinkage zone and which are evaluated after the shrinkage zone. The following identifications come to mind in this context:

visible: color invisible: selectively applied moisture peak
selectively applied temperature peak
selectively applied water mark In addition, it is possible to apply identifications before the shrinkage zone (dryer section) and to determine the local shrinkage after the shrinkage zone.

In the present invention, the paper characteristics-related data of a paper roll is passed on to the printer for optimization of the printing process. The invention is applicable not only for paper, including cardboard, but also for other printed materials.

If the converting process is, for example, a printing process, then the shrinkage that occurred during the paper production may be considered accordingly during printing in an effort to optimize the printing process.

Figure 2A:
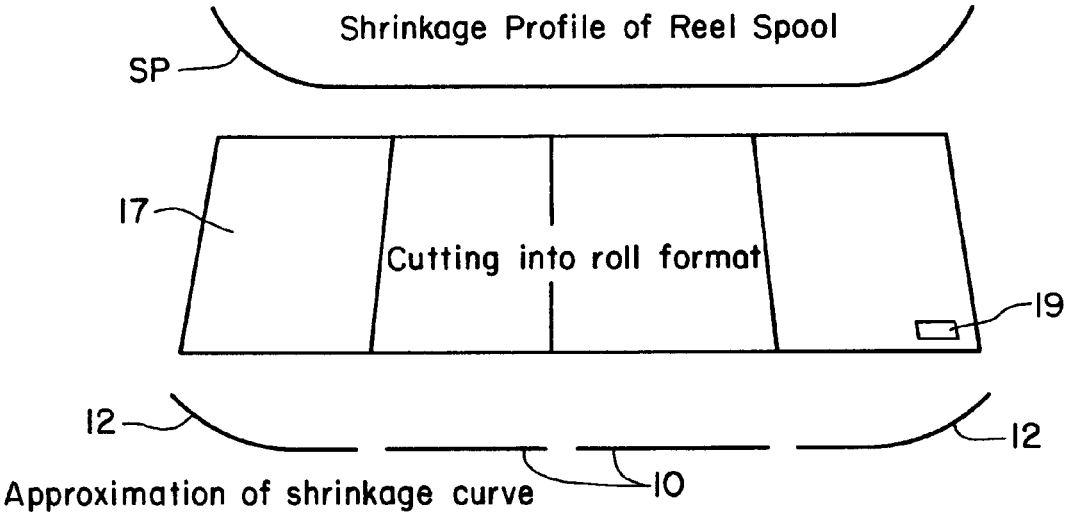
FIG. 2*a* is a schematic illustration of the shrinkage profile of a parent roll.

As can be seen from FIG. 2*a,* the shrinkage curve can, for simplification, be approximated through a straight line 10 or the segment of a circle 12' (FIG. 2*b*) and described through a deflection value 14 and an edge offset value 16.

Figure 2B:
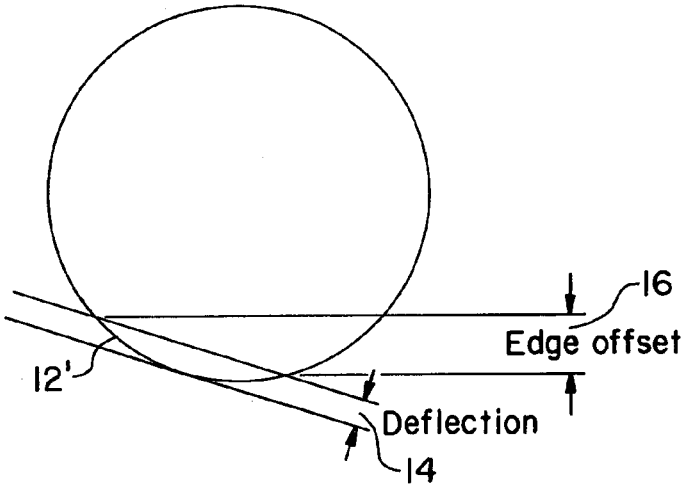
FIG. 2*b* is a schematic illustration for explanation of an approximation of the shrinkage curve and its possible description of the deflection and edge offset parameters.

FIG. 2*a* is a schematic illustration of the shrinkage profile SP of a master roll 17 whereby after cutting of slitting into roll format the result is, for example, two straight lines 10 located in the center area, as well as two edge cuts 12. Master roll 17 can be slit into a plurality of individual rolls. The shrinkage profile in the center area can therefore be approximated by a respective straight line 10. The two edge cuts 12 are approximated by a segment of a circle 12' and described by a deflection value 14 and an edge offset value 16. FIG. 2*b* depicts such an approximation for the left edge cut 12 of the shrinkage curve.

Figure 4:
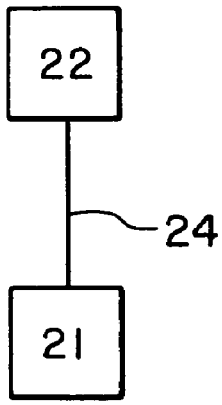
FIG. 4 is a schematic view of a data medium connected to a printer.

Data can be printed on roll 17 or a roll label 19. Data can also be stored on a separate data medium 21 (FIG. 4). The data can be transmitted to a printer 22 via a data network 24.

Figure 3:
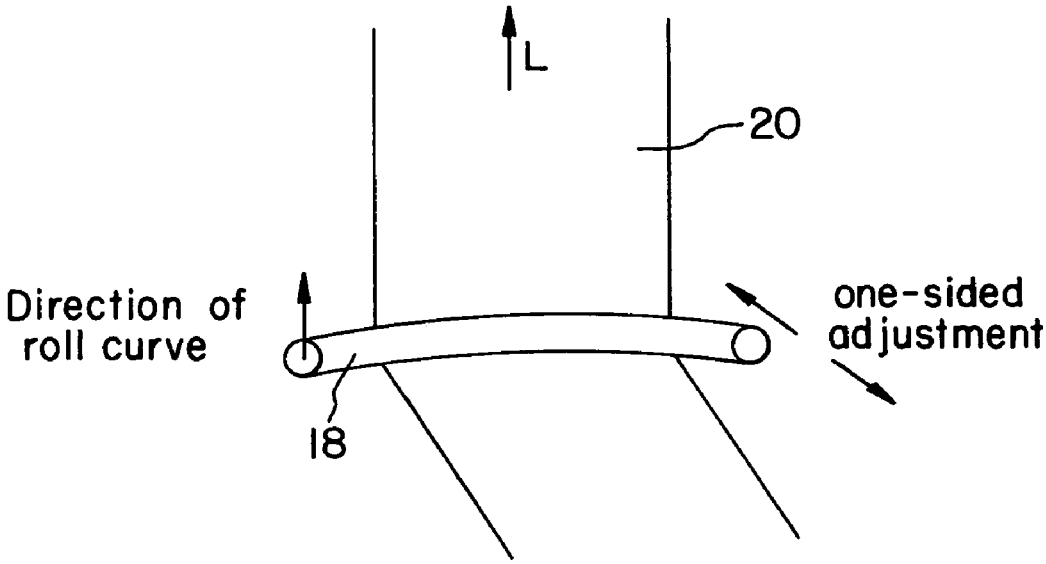
FIG. 3 is a schematic illustration of a paper web traveling around a spreader roll.

In order to compensate for uneven cross directional web tensions, a so-called spreader roll 18 (FIG. 3) may be utilized. Such a roll, originally cylindrical, progressing into a curve represents the conventional method of producing an uneven web tension. The paper 20 wraps around the spreader roll 18 specifically in an obtuse angle.

If the curve of the spreader roll 18 points toward the peak (i.e., base or point of origin) of this preferably obtuse angle, the tension in the center of the web is increased to a maximum, while reducing toward the paper edges. If the curve points in the direction of a leg of this angle, or if pivoting of the spreader roll causes the paper 20 to only touch this spreader roll 18, then the distribution of tension in the paper web 20 remains largely unchanged. By pivoting the curve of spreader roll 18 between these two positions, any intermediate values of this web tension influence may also be determined.

If paper having constant shrinkage is used for printing, then no irregular fan out is to be expected. Consequently, the web tension in the printing press should also be distributed evenly cross directionally to the direction of travel L of the paper. The spreader roll 18 would then need to be adjusted so that it has no influence over the web tension.

In order to compensate for uneven web tension during printing on a paper roll having irregular shrinkage, the spreader roll 18 is placed perpendicular to the direction of paper travel L on one side, so that this results in compensating for the edge offset 16 described in FIG. 2*a*. Then the spreader roll 18 is pivoted to such an extent that the deflection 14 as described in FIG. 2*b* is compensated for by an appropriate amount of curving (bow). In this way, an extensively constant web tension can be achieved on the paper web 20.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of manufacturing and processing paper, comprising the steps of:

determining information regarding the paper during manufacturing of the paper;

transmitting the information such that the information can be used in at least one paper converting process, each said converting process being one of printing, formatting and cutting;

compensating said converting process based on said information;

said compensating step including automatically compensating for fan out or web tension differentials of the paper during printing based on the determined information acquired during manufacturing of the paper; and considering the information during said at least one paper converting process to thereby optimize said at least one paper converting process.

2. The method of claim 1, wherein said at least one converting process comprises a printing process.

3. The method of claim 1, wherein said at least one converting process comprises a formatting process.

4. The method of claim 3, wherein said formatting process comprises a cutting process.

5. The method of claim 1, wherein the information comprises at least one of paper-specific mechanical information and paper-specific technological information.

6. The method of claim 1, wherein the information comprises one of paper-specific information regarding paper components and paper-specific information regarding paper composition.

7. The method of claim 1, wherein the information comprises at least one of paper-specific information regarding at least one characteristic and paper-specific information regarding at least one composition longitudinal profile.

8. The method of claim 1, wherein the information comprises at least one of paper-specific information regarding at least one characteristic and paper-specific information regarding at least one composition cross directional profile.

9. The method of claim 1, wherein the information comprises paper-specific information regarding at least one longitudinal profile and at least one cross direction profile of data affecting the paper.

10. The method of claim 1, comprising the further steps of:

slitting a master roll of the paper into a plurality of rolls; and allocating the information to each of said rolls via a data medium, said allocating occurring after said slitting.

11. The method of claim 10, wherein the information comprises cross directional shrinkage.

12. The method of claim 10, wherein the information comprises an average cross shrinkage value in at least one of a cross direction and a direction of web travel.

13. The method of claim 1, wherein said at least one paper converting process comprises a printing process, the information comprising shrinkage of the paper during the manufacturing of the paper.

14. The method of claim 13, wherein the information comprises location specific shrinkage values of the paper during the manufacturing of the paper.

15. The method of claim 1, comprising the further step of compensating for fan out based on an average shrinkage value of the paper.

16. The method of claim 1, comprising the further step of predicting a paper-specific fan out resulting during the manufacturing of the paper, said predicting being based on shrinkage of the paper.

17. The method of claim 1, comprising the further step of compensating for differences in paper web tension resulting from cross directional shrinkage of the paper.

18. The method of claim 1, wherein said manufacturing of the paper includes manufacturing at least one master roll of the paper, said method comprising the further step of allocating at least one data record comprising respective shrinkage values to said at least one master roll.

19. The method of claim 18, wherein said at least one data record comprises a control key allocated to each respective said master roll.

20. The method of claim 1, wherein the information includes cross directional shrinkage values of the paper, said cross directional shrinkage values being established at predetermined distances in a longitudinal direction.

21. The method of claim 1, wherein the paper has a predetermined width, the information including at least one of:

an average value of respective shrinkage values in at least one of a longitudinal direction and a cross direction; and a cross directional shrinkage.

22. The method of claim 1, wherein the information includes a shrinkage curve approximated by at least one of a straight line and a segment of a circle, said shrinkage curve being described through a deflection value and an edge offset value.

23. The method of claim 1, comprising the further step of utilizing at least one spreader roll in order to compensate for uneven cross directional web tensions.

24. The method of claim 1, comprising the further step of compensating for an uneven paper expansion by targeted moistening.

25. The method of claim 24, wherein at least one area of the paper that has lower shrinkage values is moistened more heavily than at least one area of the paper that has higher shrinkage values.

26. The method of claim 1, wherein said at least one converting process comprises a printing process, the paper comprising two end rolls and at least one center roll, said method comprising the further step of at least one of adjusting and controlling a shrinkage of the paper such that the shrinkage of the end rolls decreases substantially linearly from an outside edge of each of the end rolls to an inside edge of each of the end rolls, the shrinkage of the at least one center roll being substantially constant.

27. The method of claim 1, wherein the information includes data regarding a shrinkage of the paper, said data being printed on at least one of the paper and a roll label associated with a roll of the paper.

28. The method of claim 27, comprising the further step of storing the shrinkage data on a separate data medium.

29. The method of claim 27, comprising the further step of transmitting the shrinkage data to a printer via a data network.

* * * * *